US006041493A

United States Patent [19]

Donhauser

[11] Patent Number: 6,041,493

[45] Date of Patent: Mar. 28, 2000

[54] RIVETING TOOL

[75] Inventor: Georg Donhauser, Amberg, Germany

[73] Assignee: Kerb-Konus-Vertriebs-GmbH, Amberg, Germany

[21] Appl. No.: 09/123,373

[22] Filed: Jul. 27, 1998

[30] Foreign Application Priority Data

| | | | |
|---|---|---|---|
| Jul. 26, 1997 | [DE] | Germany | 297 13 346 U |
| Sep. 12, 1997 | [DE] | Germany | 297 16 441 U |
| Feb. 26, 1998 | [DE] | Germany | 198 08 016 |

[51] Int. Cl.[7] ..... B23P 21/00

[52] U.S. Cl. ..... 29/715; 29/243.53; 227/5

[58] Field of Search ..... 29/714, 715, 243.53, 29/243.54; 227/5

[56] References Cited

U.S. PATENT DOCUMENTS

| | | | |
|---|---|---|---|
| 2,540,942 | 3/1995 | Gast et al. | 227/112 |
| 3,557,442 | 1/1971 | Speller | 29/243.53 |
| 3,562,893 | 2/1971 | Winslow et al. | 29/243.53 |
| 3,717,023 | 2/1973 | Prosser . | |
| 3,771,480 | 11/1973 | Johnson | 29/243.53 |
| 3,874,070 | 4/1975 | Falcioni | 29/243.53 |
| 3,909,913 | 10/1975 | Tildesley | 29/432 |
| 4,091,981 | 5/1978 | Moriguchi et al. . | |
| 4,126,076 | 11/1978 | Rosman | 29/243.53 |
| 4,515,302 | 5/1985 | Davern et al. | 227/51 |
| 4,628,722 | 12/1986 | Mauer et al. . | |
| 4,726,504 | 2/1988 | Halbert | 227/51 |
| 4,744,238 | 5/1988 | Halbert . | |
| 4,770,023 | 9/1988 | Schwab . | |
| 4,864,713 | 9/1989 | Roberts et al. | 29/715 |
| 4,978,048 | 12/1990 | Purcell . | |
| 5,027,490 | 7/1991 | Roberts et al. | 29/715 |
| 5,500,990 | 3/1996 | Wihan | 29/243.525 |

*Primary Examiner*—S. Thomas Hughes
*Assistant Examiner*—Steve Blount
*Attorney, Agent, or Firm*—Larson & Taylor LLP

[57] ABSTRACT

A rivet tool has a rivet pin which can be moved in a bore of a stamp die. The tool consists of a hydraulic cylinder having two pistons in which the first piston carries the rivet pin and the second piston carries the stamp die. The chamber between the pistons is connected with a variable volume pressure chamber. The cylinder chamber, which is facing the first piston, is connected with a pressure cylinder. After a rivet has been conveyed to beneath the rivet pin, a pressure cylinder is activated and a throttle interconnected between the chamber between the pistons and the pressure chamber. The stamping process is carried out hereby and the first piston is then pressed in direction of the second piston, whereby the first piston then lies on top of the second piston to effect the stamping process.

6 Claims, 5 Drawing Sheets

RIVETING TOOL

The invention concerns a rivetting tool having a rivet pin, which can be moved in a bore of a stamp die in order to join together work pieces by means of a rivet. In a first step, the rivet is pressed through the parts to be joined together when the rivet pin moves downward. In a second step, the stamp die then produces a stamping force by means of which an anvil deforms the material of the work piece lying on the anvil, by means of which material from the work piece is pressed into a shaft groove of the rivet.

Rivetting tools of this type are used to connect two work pieces, preferably sheet metal, by means of a rivet. Rivets of this type have a rivet head and a groove on the shaft. In known tools, the two parts lying on an anvil are pressed together by a spring-loaded press pad, and a rivet pin presses a rivet through the work pieces and punched out material is thereby removed from the work pieces. When the rivet pin is moved further down, the rivet head is pressed into the hole formed by the rivet in the upper workpiece. The upper edge of a bore in the anvil is then pressed into the lower part by a stamp die, whereby the displaced material is forced into the shaft groove. A procedure of this type is described in DE-A 23 45 017, and its U.S patent equivalent, U.S. Pat. No. 3,909,913 dated Oct. 7, 1975, the contents of which are incorporated herein by reference.

The pressure exerted by a spring-loaded press pad is often insufficient to press the two parts firmly together, which is the case particularly in hard and thick sheet metals. The stability of the rivetted joint thus varies. The same disadvantage occurs when the joint parts have different tolerances. Since the movement of the stamp die is limited, the thickness tolerances must be offset by vertical adjustment of the anvil.

This invention seeks to overcome these deficiencies, and to provide an improved stamping tool in such a way that a better riveted joint is obtained between the work pieces.

Thus this invention seeks to provide a rivetting tool having a rivet pin which can be moved in a bore of a stamp die to connect parts by means of a rivet having a grooved shaft, in which the rivet is pressed through the work pieces when the rivet pin moves downward, and the stamp die then produces a stamping force by means of which an anvil works the material of the part lying on the anvil, which material is pressed into the shaft groove of the rivet, wherein a hydraulic cylinder with a first and a second piston is provided, the first piston carrying the rivet pin, the second piston carrying the stamp die, the chamber between the pistons can be connected with a variable volume pressure chamber, the cylinder chamber that is above the first piston is connected with a first pressure cylinder, and a control means is provided which, after a rivet is conveyed under the rivet pin and when the stamp die sits on the upper work piece, activates the pressure cylinder and interconnects a throttle between the chamber between the first and second pistons and the pressure chamber and, to carry out the stamping process and to exert a retaining force by means of the stamp die, the pressure of the pressure cylinder presses the first piston in the direction of the first piston until the first piston lies on the second piston to carry out the lower work piece deformation step.

Preferably, the throttle resistance of the throttle is adjustable.

Preferably, the first piston has a hollow piston rod which is connected with the throttle, and bores in the hollow piston rod pass through the first piston and connect with the chamber between the first and second pistons.

Preferably a second pressure cylinder is provided which can be connected with the cylinder chamber above the first piston, and which produces a pressure that is less than that of the first pressure cylinder, and greater than that in the pressure chamber so that, when activated, the first piston is pressed in the direction of the second piston until the first and second pistons are at a preset distance from one another, after which the cylinder chamber is then connected with the first pressure cylinder.

Preferably, a third pressure cylinder is provided which can be connected with the cylinder chamber that is above the first piston, which produces a pressure that is less than that in the pressure chamber so that, when activated, both the first and second pistons are pressed in the direction of the work pieces until the stamp die comes in contact with the upper work piece, after which the cylinder chamber is then connected with the second pressure cylinder.

Preferably, the rivet pin held in the stamp die has a bore extending along the rivet pin which can be connected to a low-pressure source, the bore ending at the tip of the rivet pin.

Preferably, a sleeve housing is located in the area of the tip of the rivet pin, in which a slide which can be moved diagonally to the rivet pin which moves the rivet into place at the tip.

An embodiment will be described in greater detail in the following with reference to the drawings, in which.

Figure 1A:
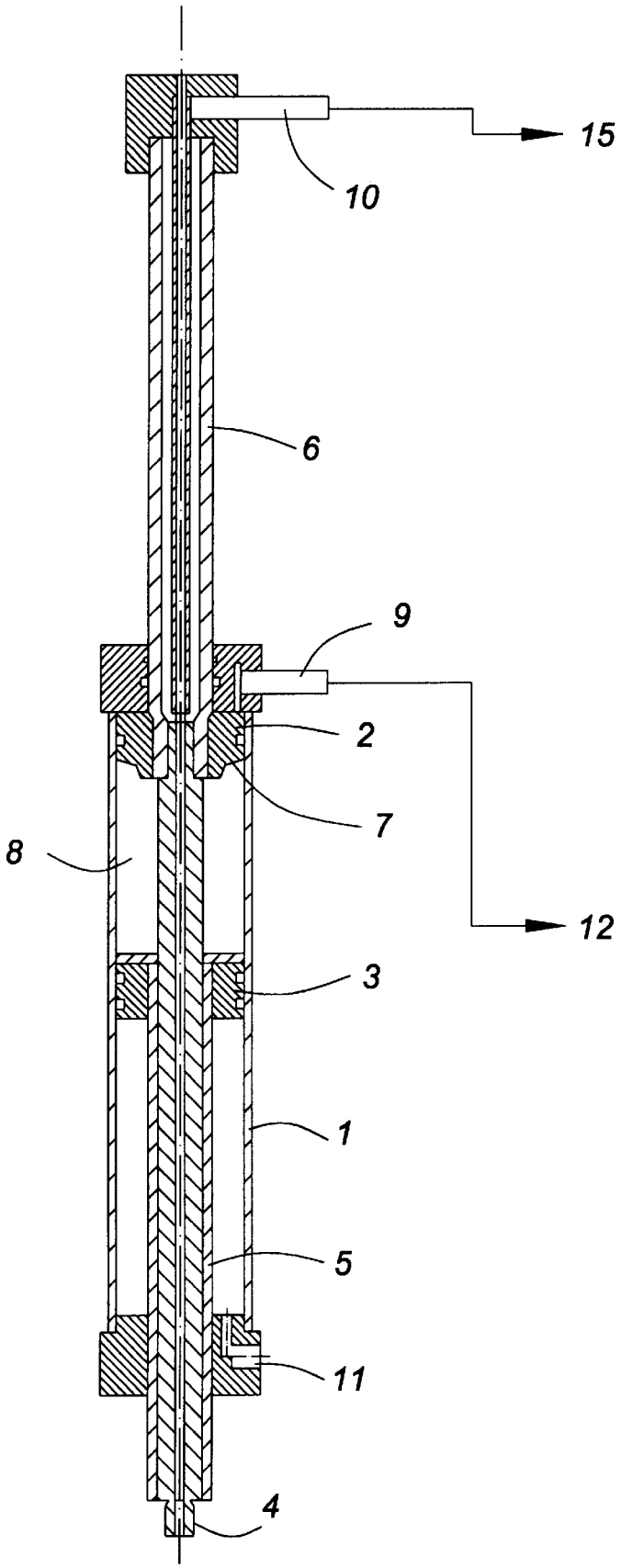
FIGS. 1A and 1B shows a section through the hydraulic cylinder and the units attached thereto.

The stamping tool has a hydraulic cylinder 1 in which a first piston 2 and a second piston 3 are moveable. The rivet pin 4 is connected with the first, upper, piston 2, while a press cylinder is connected with the second, lower, piston 3; the press cylinder also carries the stamp die (not shown in FIG. 1). Furthermore, a hollow piston rod 6 is connected with the first piston 2. The first piston 2 has bores 7 which connect the chamber 8 between the first and second pistons 2, 3 with the interior of the piston rod 6. Cylinder 1 has a connection 9 which opens into the cylinder chamber above the first piston 2. The interior of the piston rod 6 is connected with a further connection 10, while the cylinder chamber is connected with a third connection 11 below the second piston 3.

Figure 1B:
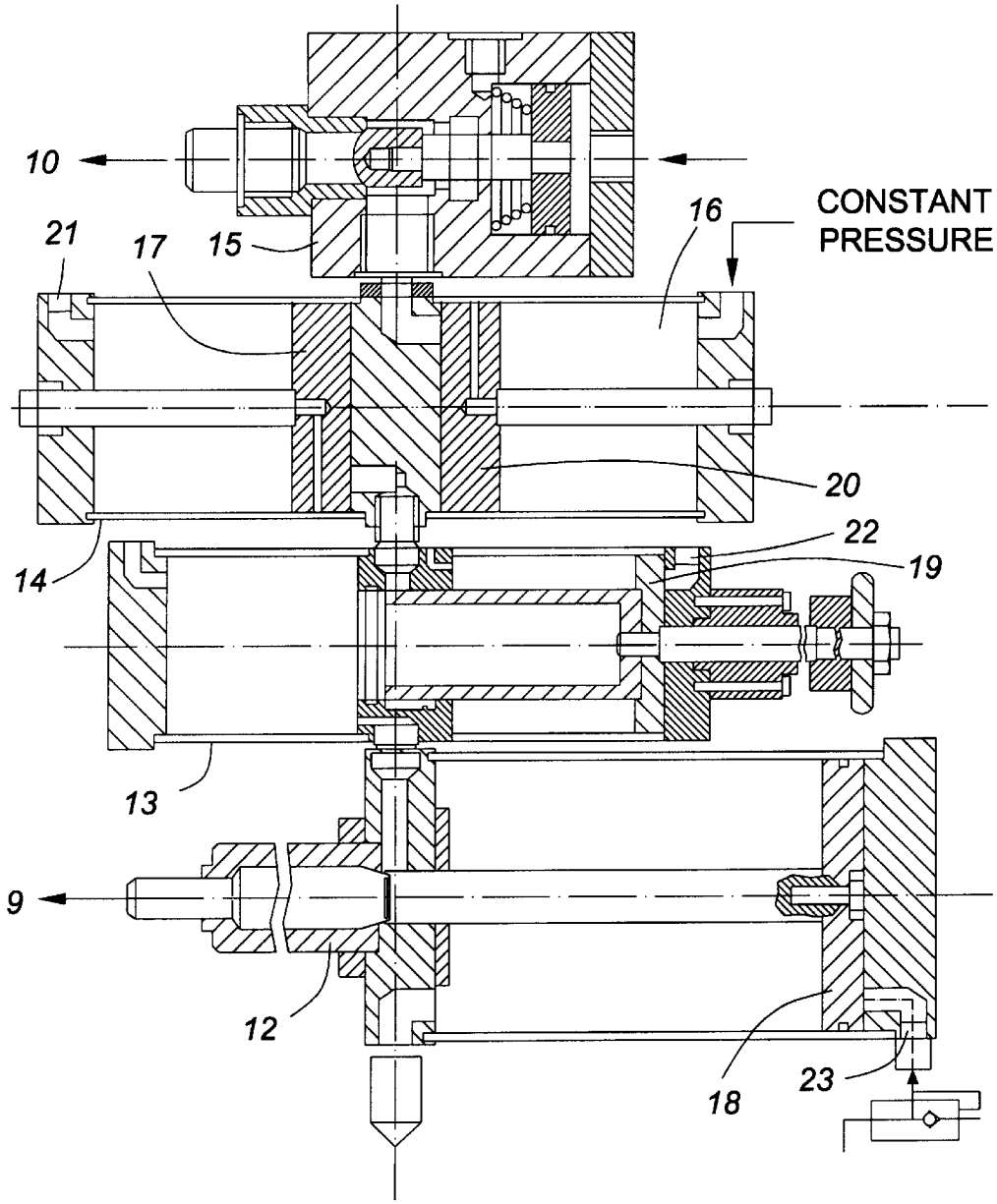

Referring to FIG. 1B, a first pressure cylinder 12 is connected with connection 9; this pressure cylinder can be connected to a second pressure cylinder 13 to which, for its part, a third pressure cylinder 14 may be connected. Connection 10 is connected to an adjustable throttle 15 which in turn is connected to a variable volume pressure chamber 16.

The sequence of operations is as follows (see FIG. 1B). The piston 17 of the third pressure cylinder 14 is initially in position shown in the left part of the cylinder. Pistons 18 and 19 of the first and second pressure cylinders 12, 13 are at the right hand end positions as shown. As a result of this, there is a hydraulic connection from the third pressure cylinder 14 via the second pressure cylinder 13 and the first pressure cylinder 12 to connection 9. The throttle 15 is opened, so that there is a direct connection between the chamber 8, (FIG. 1A) the bores 7, the hollow piston rod 6, the connection 10, and from the throttle 15 to the left side of the piston 20 of the pressure chamber 16. A constant pressure acts on the right side of the piston 20.

After a rivet has been conveyed to the lower end of the rivet pin 4, which is held there by low pressure, compressed air is conveyed via the connection 21 to the third pressure cylinder 14 as a result of which its piston 17 is pressed toward the right and pressure is conveyed via the second pressure cylinder 13 and the first pressure cylinder 12 to the connection 9, since the connections between all pressure cylinders are open. A pressure determined by the pressure chamber 16 prevails in chamber 8 between the first and second pistons 2, 3. This pressure in chamber 8 is greater than the pressure exerted by pressure cylinder 14 which acts on the upper end of the first piston 2. It is hereby achieved that, when oil is supplied to connection 9, both the first and second pistons 2, 3 are synchronously moved downward.

If the stamp die (FIG. 2) abuts against the upper work piece 24A during this downward movement, a counterpressure builds up in the third pressure cylinder 14 on the right side of the piston 17. When a preset counterpressure is attained, the second pressure cylinder 13 is activated thereby that compressed air is supplied via the connection 22 located there which moves piston 19 toward the left. The connection between the third pressure cylinder 14 and the second pressure cylinder 13 is thereby closed and an oil pressure is produced which is greater than the oil pressure in chamber 8. The oil conveyed from pressure cylinder 13 to connection 9 causes the first piston 2 to move closer to the second piston 3, whereby the oil in chamber 8 is conveyed into the pressure chamber 16 and the piston 20 is thereby shifted to the right.

If the first piston 2 has moved closer to the second piston 3 by a preset distance which is greater than the length of the rivet, the first pressure cylinder 12 is activated thereby so that piston 18 is moved to the left by compressed air supplied at connection 23. The connection between the first and second cylinders 12, 13 is interrupted during this movement. Oil is conveyed from the first pressure cylinder 12 under high pressure to connection 9. When the first pressure cylinder 12 is actuated, throttle 15 is also activated so that a throttle resistance builds up between connection 10 and pressure chamber 16. This throttle resistance is adjustable.

Figure 3:
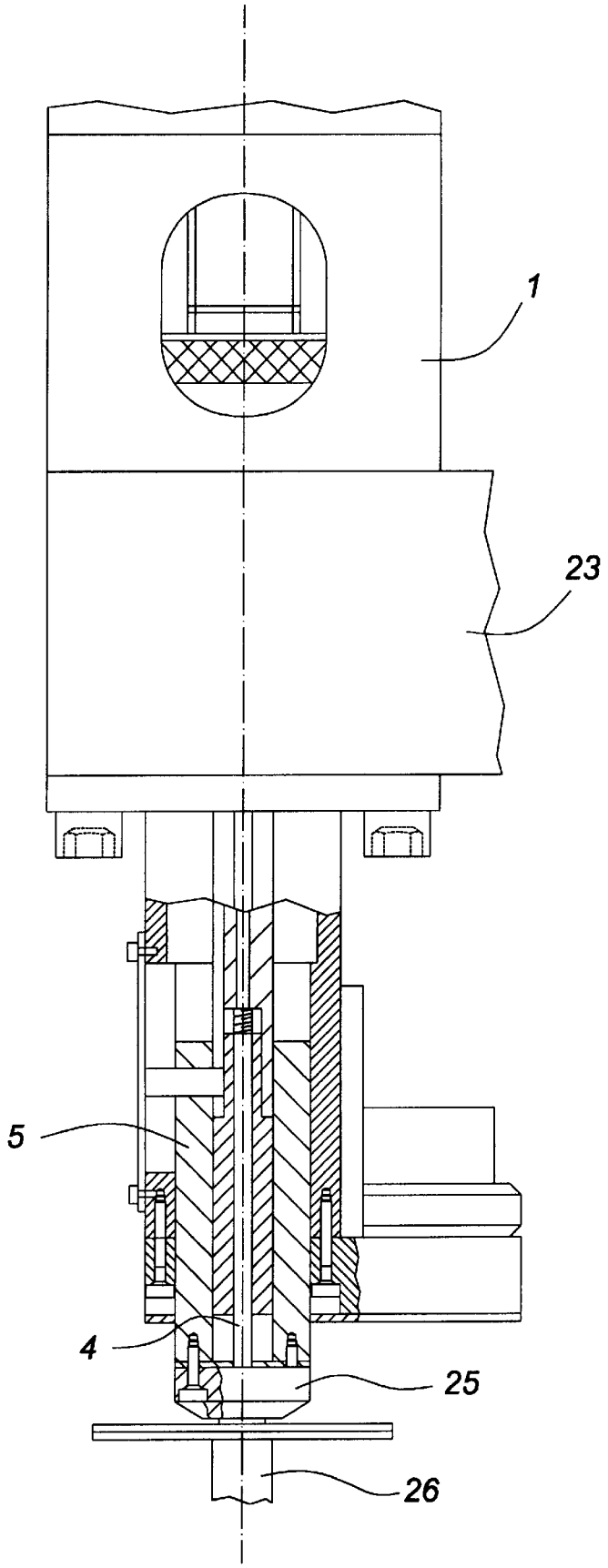
FIG. 3 shows a representation corresponding to FIG. 2 with press pads abutting the joint parts.
Figure 4:
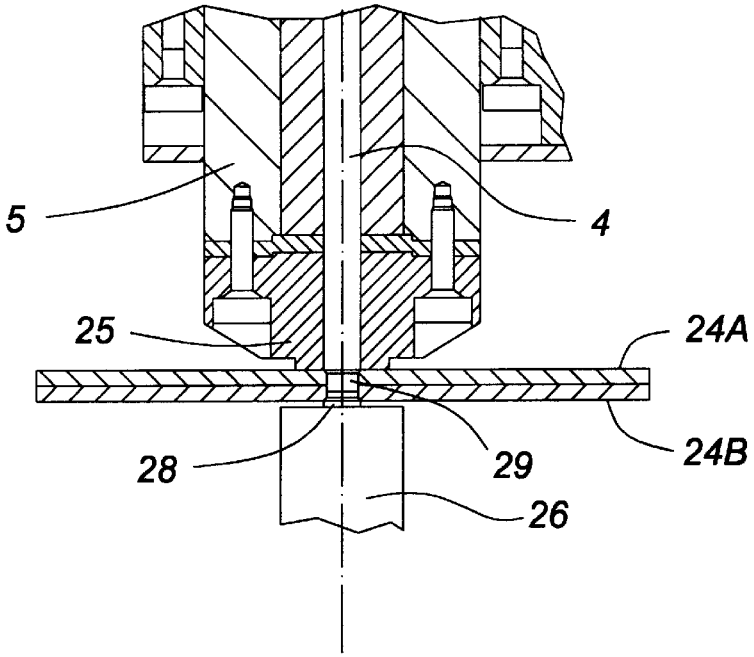
FIG. 4 shows a section through the head when placing the rivet.

Thus, a high pressure, which is nevertheless adjustable due to the throttle resistance, acts on the second piston 3 which results therein that the stamp die 25 fastened to the pressure cylinder 5 exerts a high clamping force on the work pieces 24A, 24B, which are thus adjacent to one another without any gaps, as is shown in FIG. 3. At the same time, the rivet 29 is pressed through the work pieces 24A, 24B by the rivet pin 4 and the rivet head into the bore produced in the upper work piece 24A, as shown in FIG. 4.

Figure 5:
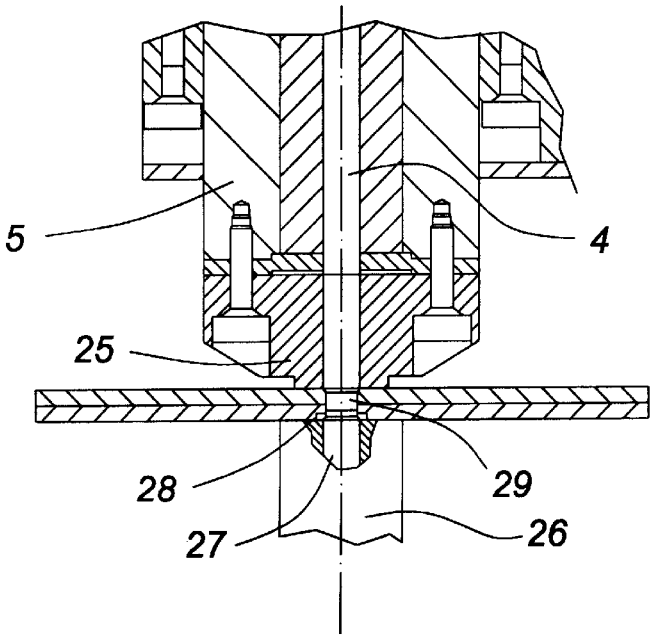
FIG. 5 shows a representation corresponding to FIG. 4 when stamping the joint parts.

At the end of its downward movement, the first piston 2 sits on the second piston 3, as a result of which the stamp die 25 is pressed with a high pressure on the upper work piece 24A and the stamping lip 28 of the anvil 26 is pressed into the lower work piece 24B and the displaced material is forced into the shaft groove of the rivet 29. The rivetting process is thus completed, as shown in FIG. 5.

Pistons 17, 18, 19 then return to their initial position, throttle 15 is opened, and the oil pressure in the pressure chamber 16 separates the two first and second pistons 2, 3 from one another. At the same time, a pressure is built up below the second piston 3 via connection 11 so that both the first and second pistons 2, 3 return to their initial position.

Figure 2:
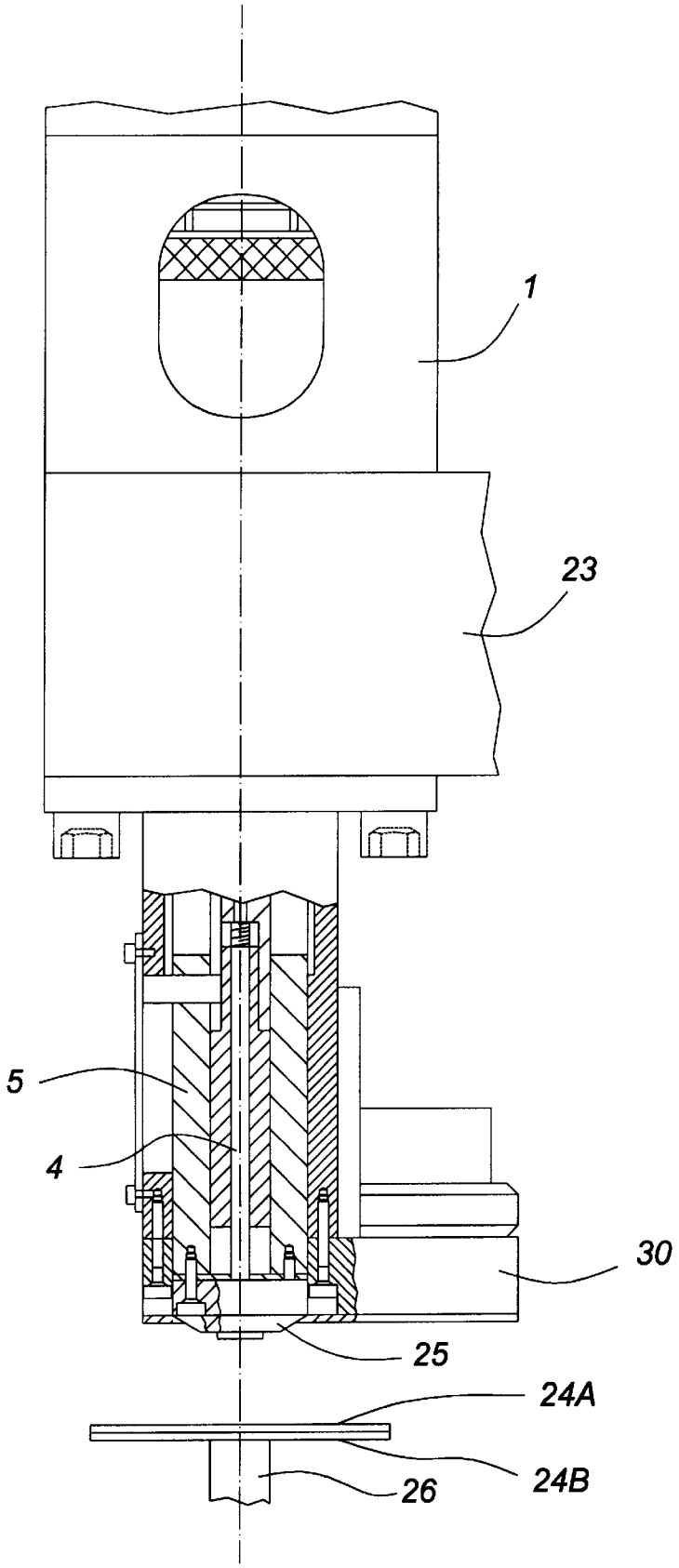
FIG. 2 shows a side elevation of the tool in its initial position with cut head having a short mouthpiece.

As shown in FIGS. 2 and 3, the hydraulic cylinder 1 is connected with the tool rack via a C-bracket 23. The tool head comprises the rivet pin 4 and the stamp die 25 which has a bore through which the rivet pin 4 can be moved. The stamp die 25 is fastened to the pressure cylinder 5. At the level of the lower end of the rivet pin 4, a sleeve housing 30 (FIG. 2) is flange-mounted, the slide of which conveys the rivet 29 to the lower end of the rivet pin 4.

The stamp die 25 acts as a press pad. The parts 24A and 24B to be joined together lie on the anvil 26. This anvil 26 is provided with a bore 27 which is surrounded by a stamping lip 28.

Proceeding from the position in FIG. 2, the rivet pin 4 and the stamp die 25 are lowered into the position of FIG. 3 in which the stamp die 25 presses the work pieces 24A and 24B together and against the anvil 26. The rivet pin 4, at whose lower end the rivet 29 is being held, is then moved through the bore in the stamp die 25, whereby rivet 29 is pressed through the work pieces 24A, 24B until the rivet head forms a flush surface with the surface of the upper work piece 24A. The stamped out material falls through the bore 27 of the anvil 26. Once the rivet 29 has been set, the stamp die 25 presses against the work piece 24A with a high pressure. The stamping on anvil 26 thereby forces its way in about the lower end of the rivet shaft into the work piece 24B, whereby material from the work piece 24B is pressed into the shaft groove of the rivet 29.

I claim:

1. In a rivetting tool having a rivet driving pin which can be moved in a bore of a stamp die to connect work pieces by means of a rivet having a grooved shaft, in which the rivet is pressed through the work pieces when the rivet pin moves downward, and the stamp die then produces a stamping force by means of which an anvil works the material of the work piece lying on the anvil, by means of which material is pressed into the shaft groove of the rivet, the improvement comprising a hydraulic cylinder with a first and a second piston, the first piston connected to the rivet pin by a first piston rod, the second piston connected to the stamp die by a first hollow piston rod concentric with the first piston rod, a chamber between the first and second pistons in said hydraulic cylinder is connected with a variable volume pressure chamber, a second chamber in said cylinder that is on the side of said first piston remote from said second piston is connected with a first pressure cylinder, and a control means which, after a rivet is conveyed to under the rivet pin and when the stamp die sits on the upper work piece, activates the first pressure cylinder and interconnects a throttle between the chamber between the first and second piston and the pressure chamber whereby to carry out the stamping process and to exert a retaining force by means of the stamp die, the pressure of the pressure cylinder presses the first piston in the direction of the second piston until the first piston lies on the second piston to carry out the stamping step.

2. A rivetting tool according to claim 1, wherein a throttle resistance of the throttle is adjustable.

3. A rivetting tool according to claim 1, wherein the first piston has a second hollow piston rod which is connected with the throttle, and bores in the second hollow piston rod pass through the first piston and connect with the chamber between the first and second pistons.

4. A rivetting tool according to claim 1, wherein a second pressure cylinder is provided which is connected with the cylinder chamber and which faces the first piston, and which produces a pressure that is less than that of the first pressure cylinder, and greater than that in the pressure chamber so that, when activated, the first piston is pressed in the direction of the second piston until the first and second pistons are at a preset distance from one another, after which the cylinder chamber is then connected with the first pressure cylinder.

5. A rivetting tool according to claim 4, wherein a third pressure cylinder is provided which is connected with the cylinder chamber that is facing the first piston, which produces a pressure that is less than that in the pressure chamber so that, when activated, both the first and second pistons are pressed in direction of the joint parts until the stamp die comes in contact with the upper joint part, after which the cylinder chamber is then connected with the second pressure cylinder.

6. A rivetting tool according to claim 1, wherein a sleeve housing is located in the area of an end of the rivet pin, in which a slide which can be moved diagonally to the rivet pin which moves the rivet into place at the tip.

* * * * *

UNITED STATES PATENT AND TRADEMARK OFFICE

CERTIFICATE OF CORRECTION

PATENT NO. : 6,041,493
DATED : March 28, 2000
INVENTOR(S) : Donhauser

It is certified that error appears in the above-identified patent and that said Letters Patent is hereby corrected as shown below:

The (un-numbered) passage in the center horizontal element of pressure cylinder 14 and in the center horizontal element of pressure chamber 16 in the top/middle of figure 1B is now present in the (enlarged) top/middle portion of figure 1B provided below.

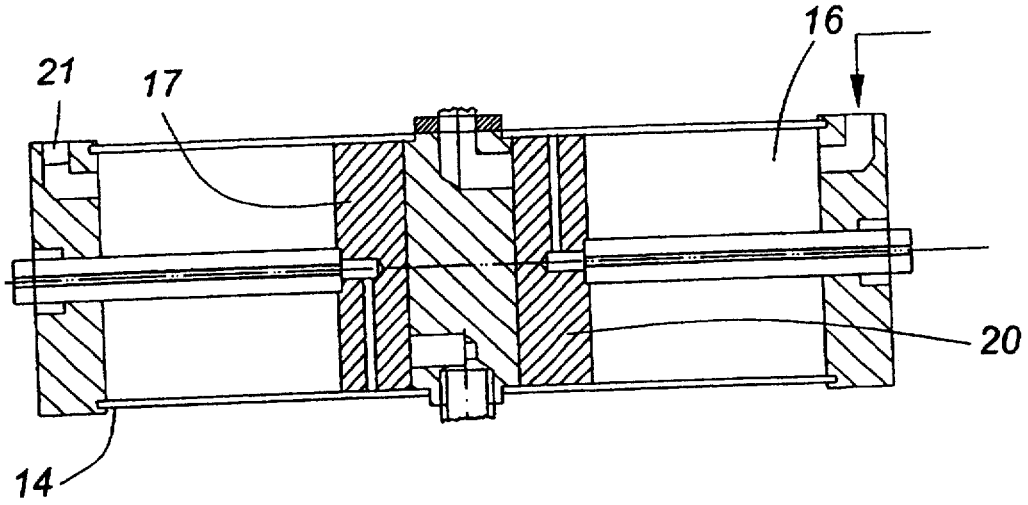

UNITED STATES PATENT AND TRADEMARK OFFICE

CERTIFICATE OF CORRECTION

PATENT NO. : 6,041,493
DATED : March 28, 2000
INVENTOR(S) : Donhauser

It is certified that error appears in the above-identified patent and that said Letters Patent is hereby corrected as shown below:

The bores 7 (only one of which is numbered) from the interior of piston 6 to chamber 8 at the middle of figure 1A is now present in the (enlarged) middle portion of figure 1A provided below.

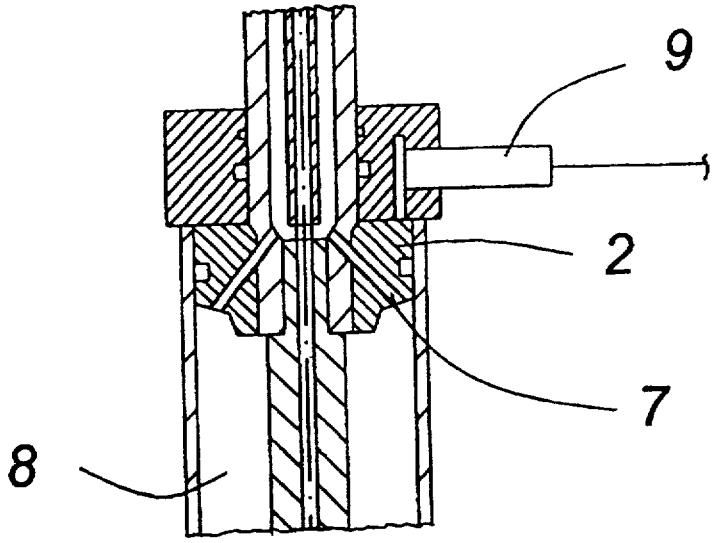

UNITED STATES PATENT AND TRADEMARK OFFICE

CERTIFICATE OF CORRECTION

PATENT NO. : 6,041,493
DATED : March 28, 2000
INVENTOR(S) : Donhauser

It is certified that error appears in the above-identified patent and that said Letters Patent is hereby corrected as shown below:

The (un-numbered) passage from connection 10 to the interior of piston 6 at the top of figure 1A is now present in the (enlarged) top portion of figure 1A provided below.

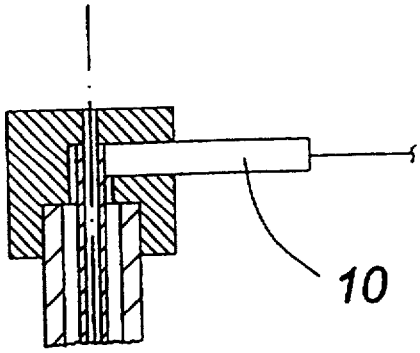

Signed and Sealed this

Third Day of July, 2001

Nicholas P. Godici

*Attest:*

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,041,493
DATED : March 28, 2000
INVENTOR(S) : Donhauser

It is certified that error appears in the above-identified patent and that said Letters Patent is hereby corrected as shown below:

The (un-numbered) passage in the center horizontal element of pressure cylinder 14 and in the center horizontal element of pressure chamber 16 in the top/middle of figure 1B is now present in the (enlarged) top/middle portion of figure 1B provided below.

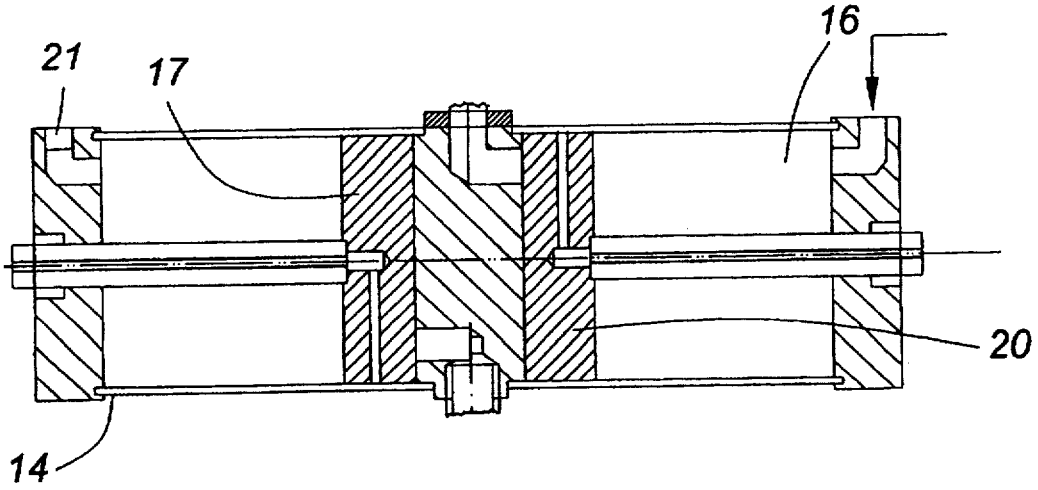

UNITED STATES PATENT AND TRADEMARK OFFICE

CERTIFICATE OF CORRECTION

PATENT NO. : 6,041,493
DATED : March 28, 2000
INVENTOR(S) : Donhauser

It is certified that error appears in the above-identified patent and that said Letters Patent is hereby corrected as shown below:

The bores 7 (only one of which is numbered) from the interior of piston 6 to chamber 8 at the middle of figure 1A is now present in the (enlarged) middle portion of figure 1A provided below.

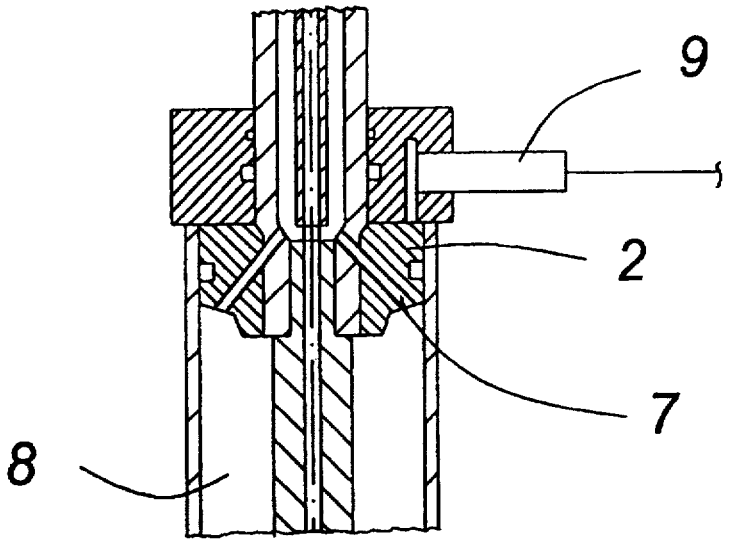

UNITED STATES PATENT AND TRADEMARK OFFICE

CERTIFICATE OF CORRECTION

PATENT NO. : 6,041,493
DATED : March 28, 2000
INVENTOR(S) : Donhauser

It is certified that error appears in the above-identified patent and that said Letters Patent is hereby corrected as shown below:

The (un-numbered) passage from connection 10 to the interior of piston 6 at the top of figure 1A is now present in the (enlarged) top portion of figure 1A provided below.

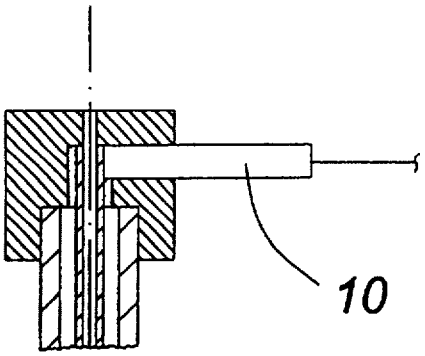

Signed and Sealed this

Seventh Day of August, 2001

Nicholas P. Godici

*Attest:*

*Attesting Officer*

NICHOLAS P. GODICI
*Acting Director of the United States Patent and Trademark Office*